US005165373A

United States Patent [19]

Cheng

[11] Patent Number: 5,165,373

[45] Date of Patent: Nov. 24, 1992

[54] ELECTRO-THERMAL PULSED FUEL INJECTOR AND SYSTEM

[76] Inventor: Dah Y. Cheng, 12950 Cortez La., Los Altos Hills, Calif. 94022

[21] Appl. No.: 705,501

[22] Filed: May 24, 1991

[51] Int. Cl.[5] ..... F02M 45/06; F02M 45/08

[52] U.S. Cl. ..... 123/300; 239/5

[58] Field of Search ..... 123/294, 299, 300; 239/5, 13; 417/207, 208, 209

[56] References Cited

U.S. PATENT DOCUMENTS

| | | | |
|---|---|---|---|
| 1,686,887 | 10/1928 | Van Hise | 417/52 |
| 2,436,090 | 2/1948 | Bodine, Jr. | 123/266 X |
| 2,578,145 | 12/1951 | Miller | 123/305 X |
| 3,133,507 | 5/1964 | Van Der Ster | 417/208 |
| 3,361,353 | 1/1968 | Millman | 123/294 X |
| 3,575,146 | 4/1971 | Creighton et al. | 123/299 |
| 3,731,876 | 5/1973 | Showalter | 239/13 |
| 3,898,017 | 8/1975 | Mandroian | 417/65 |
| 4,483,304 | 11/1984 | Yokoi et al. | 123/549 |
| 4,621,599 | 11/1986 | Igashira et al. | 123/300 |
| 4,792,283 | 12/1988 | Okayasu | 417/52 |

FOREIGN PATENT DOCUMENTS

| | | | |
|---|---|---|---|
| 777261 | 11/1980 | U.S.S.R. | 417/52 |

*Primary Examiner*—Tony M. Argenbright
*Attorney, Agent, or Firm*—Cooper & Dunham

[57] ABSTRACT

A concept of pulse input thermal energy to induce a rapid volume change in a vessel is introduced to provide rapid pressure raise as a means to inject fuel into internal combustion engines. A computer and sensor means are incorporated to provide pulse width, height and multiple pulse using engine conditions such as RPM, exhaust pollution and efficiency, etc. as control parameters.

11 Claims, 10 Drawing Sheets

ELECTRO-THERMAL PULSED FUEL INJECTOR AND SYSTEM

BACKGROUND-FIELD OF INVENTION

An electro-thermal pulsed energy fuel injection system for fuel flow rate control through pressure pulse width.

BACKGROUND-DESCRIPTION OF PRIOR ART

With improvement in internal combustion engines, the air/fuel distribution adds the requirements of timing and air quality control. Fuel injection to piston engines is one of the means to achieve the goal. Known fuel injection systems are using a mechanical pump to produce high pressure, then either mechanical or electromagnetic means are used to control the timing of the fuel injection. In the case of the diesel engine, it is even more complex due to the high pressure required to inject the fuel into the cylinder.

Diesel engines are more efficient, in general, than gasoline engines because of their inherent high pressure ratio and because they can operate at very lean fuel-air ratios. Diesel invented the cycle to mimic closely the Carnot Cycle, and the centerpiece of his difficulty was the "programmed coal powder injection" to give him the constant pressure combustion. Cummins invented the liquid fuel injector to put the diesel engine on the commercial market and founded the Cummins Engine Company, but he did it with the sacrifice of the idea of constant pressure combustion. Diesel engines can improve efficiency by implementing a controlled fuel injection system. The current mechanical fuel injection system using a high pressure fuel pump normally creates a high-burst pressure for the combustion of the injected fuel. It is not uncommon to have fuel pressure which exceeds 3000 psi before injection. The reason for having the high pressure is twofold. First, a diesel cycle operating in "self-ignition mode" has to be a high pressure ratio machine, and higher pressure is necessary before fuel can be injected into the engine. Second, the injector is also an atomizer, which injects the fuel in the form of fine droplets, which also requires pressure.

It is the second element which influences the ability of the engine to operate at a higher RPM. The atomization process is a method of suddenly increasing the surface area of a given volume. The work done is against the surface tension. The energy to do the work is stored in the form of compression energy, which is partially compression of the diesel fuel and partially the spring property of the fuel line. The fuel line from the diesel pump to the fuel injector is usually highly tuned.

Another difficulty of the injection system is that its mechanical linking to the engine makes it difficult to advance timing when the RPM is changed. This is the major reason that gasoline engines equipped with a spark ignition timing system allow convenient increase of the RPM. The advance in timing is to compensate the ignition delay of the fuel combustion. This may be one of the major bottlenecks of diesel engines. As in the gasoline engine, the tuning of the engine is mostly an advanced time mechanism.

Many attempts have been made to improve diesel fuel injection systems, especially in the area of piezoelectric fuel injector systems. The piezoelectric system utilizes an electrical pulse put across the surface of a piezoelectric crystal. The result is to change the dimension of the crystal in the direction of applied voltage. The deformation of the crystal is very small; therefore, usually a large stack of piezoelectric crystals are required in order to provide enough displacement to be useful. The piezoelectric crystal does not change its volume, so when the compression of the piezoelectric crystal is done by the applied voltage, the dimension expands perpendicular to the applied voltage direction of the crystal. The net result is that the volume of the crystal remains approximately a constant. A piezoelectric crystal cannot therefore be used as a pump effectively. The application to date has been to use the piezoelectric stack to relieve the fuel pressure from the injection line as an electrically controlled cut-off system; therefore, the fuel pump can be made much more easily without a spiral timing device and also does not have to rotate through a rack and pinion system for the time duration control. Unfortunately, such a system is very expensive and has only been tried experimentally on large diesels. The RPM issue cannot be addressed, because the beginning of the timing of injection of the fuel is still controlled mechanically by a high pressure fuel pump. Other electrical-mechanical devices have been tried, but none can produce the rapid pressure rise required to inject the controlled amount of fuel. The duration of the injection at 6000 RPM is about a millisecond or less, and the amount of fuel injected is on the order of milligrams for most small engines.

OBJECTS AND ADVANTAGES

The objective of the invention is to remove or reduce the pressure raise of mechanical fuel pumps for pulsed fuel injection systems. A new concept by rapidly pulsing thermal energy to convert fuel from liquid phase to vapor phase then collapse the vapor volume when heat input is removed as a means to produce sharp pressure drop-off for fuel cut-off is introduced. The system can electrically heat a high temperature wire such as platinum or can use a high voltage system to draw a controlled electrical arc. Since no air is present, no combustion would be induced. This rapid change of thermal energy transfers the heat to the fuel, heating it rapidly to a vapor state. The changing from liquid to vapor state requires a change in volume of several orders of magnitude change in volume. In a small volume chamber, very high pressure is produced. This method essentially removes the need of a very high pressure fuel pump. The electrical pulsing is extremely manageable with today's electronic circuitry. An artificial intelligence program for fuel pulse management would be possible for the monitoring of engine requirements such as output horsepower, RPM, engine conditions such as NOx, smoke and knocking effects via analog to digital converters. This invention simplifies the mechanical system and makes use of computer technology. The advantage of the Applicant's invention is to overcome obstacles in mechanical pump high pressure fuel injection systems. The objective is to make it mechanically simple. For example, other objectives are:

a) to reduce injector size;

b) to reduce the surface tension of fuel by heating;

c) to reduce the droplet mist size;

d) to improve the interface of computer to fuel management; and e) to reduce pollution and smoke.

Other benefits include the ability to have constant pressure combustion, so a diesel engine can be closer to the cycle Diesel invented, and, in the case of the gasoline engine, direct cylinder fuel injection becomes feasible again.

DRAWING FIGURES

DESCRIPTION - FIGS. 1 to 8

Figure 1:
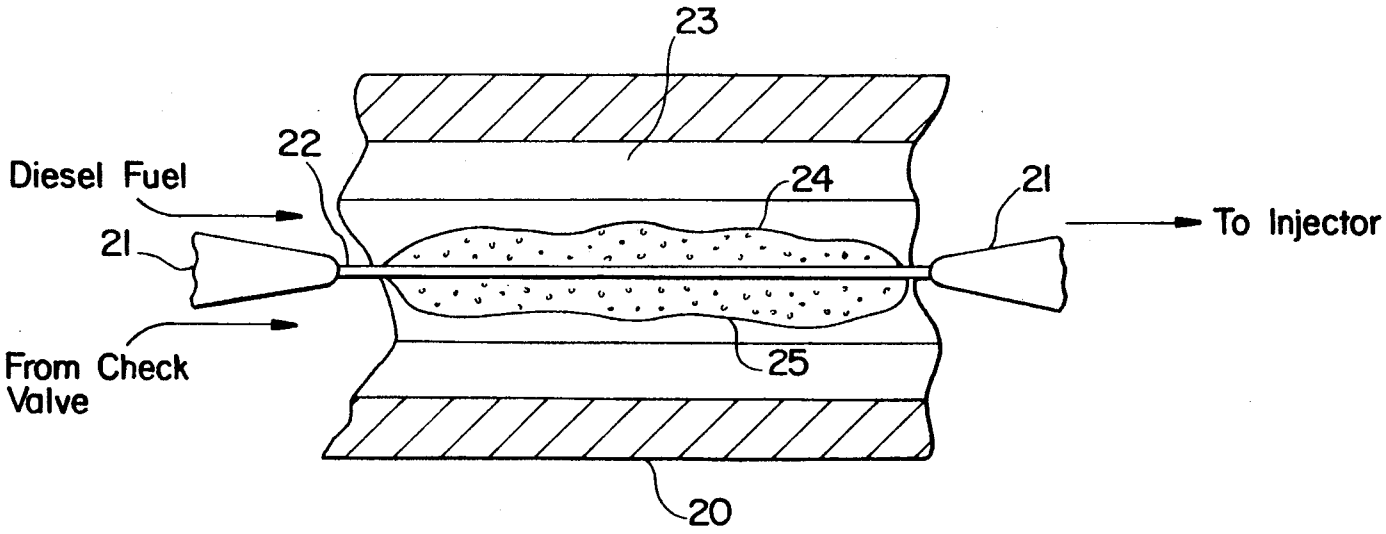
FIG. 1 illustrates the pressure pulse generating system in a fuel line.

FIG. 1 is a typical electro-thermal pressure generating pulse device. The fuel line which carries high pressure fuel is 20; an optional insulating quartz liner is 23. The electrode which carries the electrical current into the device is 21, and the heating element (typically of high temperature alloy) is 22. The fuel is 24, and the vapor due to the rapid heating of the fuel is 25. FIG. 1 illustrates the mechanism of rapid heating by an electrical pulse to heat a platinum wire to high temperature; therefore, the liquid surrounding the wire evaporates into vapor, and the volume change from liquid to vapor produces a pumping mechanism to produce a pressure wave in terms of a shock wave.

Figure 2:
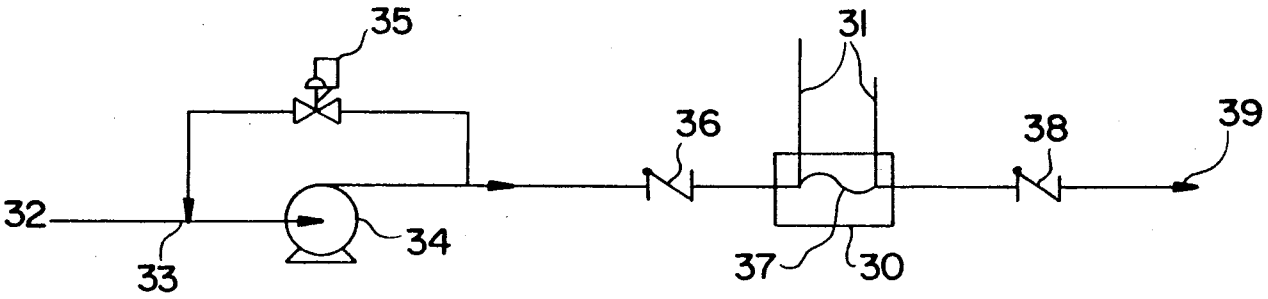
FIG. 2 is a simplified diagram of fuel system plumbing.

FIG. 2 illustrates a typical plumbing system for the a fuel injection system described in FIG. 1. The pumping system starts from the fuel tank inlet 32 and goes into the inlet pipe joined with a return line 33, the fuel primary pump 34, a bypass pressure regulator 35, and check valves 36 and 38. The heating element is 37, the enclosure to produce high pressure pulse is 30, and the electrodes are 31. 39 is the direction to go into the fuel injector.

Figure 3:
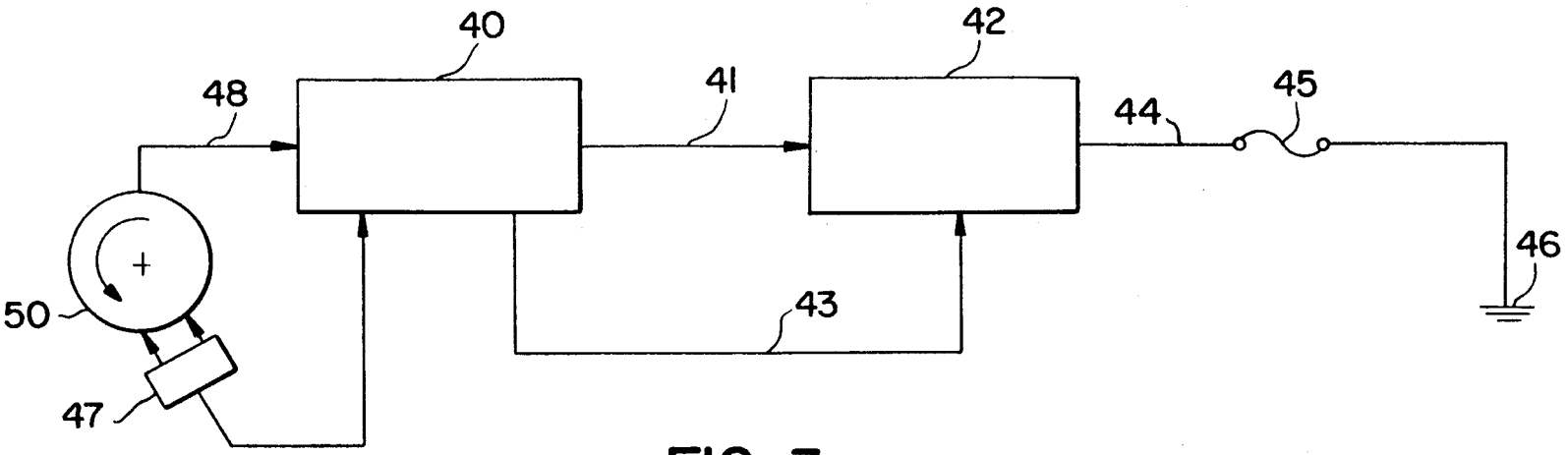
FIG. 3 is a simplified block diagram of the timing control system, including sensors, computer, energy delivery pulse network and an energizer.

FIG. 3 is a typical block diagram of the system described in FIG. 1. The sensor is 47, and the crank shaft gearing to indicate the position of the crank angle is 50. The feedback of the signal comes from the crank angle, and the sensor for injection advance 47 is feeding through the lines 48 and 49 to a computer 40. Other sensing elements are not illustrated here in order to compensate for the advanced delayed angles for fuel injection. The computer puts out a trigger to send out a pulse for heating. The trigger 41 is sending a signal pulse to go through a pulse energy network. A cut-off pulse is generated by line 43, and the pulse network is indicated by the network 42. The energy delivered from the pulse network going through line 44 heating the element inside the fuel line 45, returning the current to the ground 46.

Figure 4:
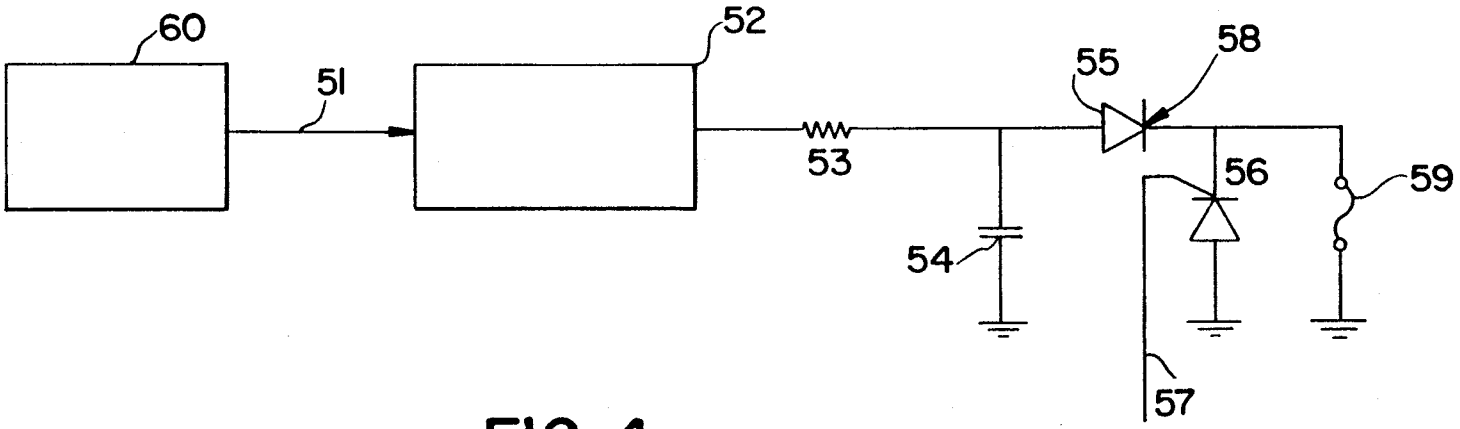
FIG. 4 depicts a simple circuit diagram for energy delivery pressure control.

In FIG. 4, a typical pulse network is illustrated. A battery supply 60 travels through the signal or the power cable 51 to a DC-to-high voltage converter 52 and a current limiter 53 to charge an energy storage capacitor 54. A typical thyratron switch $$ receives the trigger signal from the computer at 58, and the signal is cut off by a crowbar switch as a possible means for the sharp pulse network cutoff. Another thyratron silicon controlled rectifier is 56, the crowbar signal is 57, and the Pt wire in this case is 59.

Figure 5:
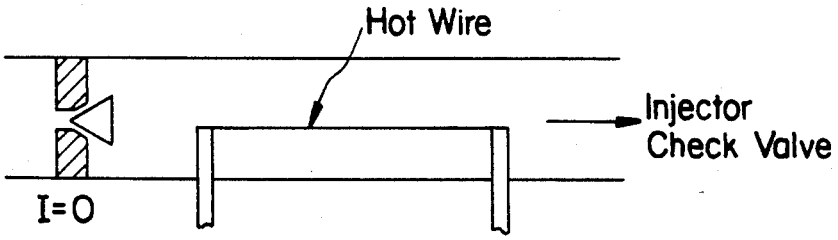
FIG. 5 is an illustration of a fuel flow system incorporating a check valve when no energy is put into the system.

FIG. 5 illustrates the mechanism of the check valve such that when the current is zero, the check valve is open due to the primary pump to fill the line of the fuel system.

Figure 6:
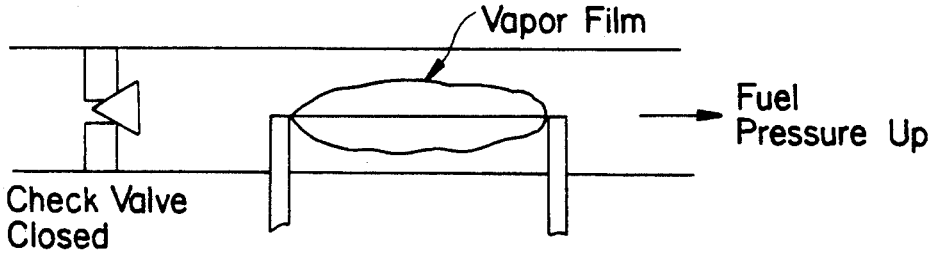
FIG. 6 illustrates a closed check valve resulting from a sudden increase in volume due to the energy input.

In FIG. 6, the vapor is generated by the electrical current converting from the liquid to vapor phase to high pressure, forcing the check valve to close, causing the flow of fuel to go in one direction.

Figure 7:
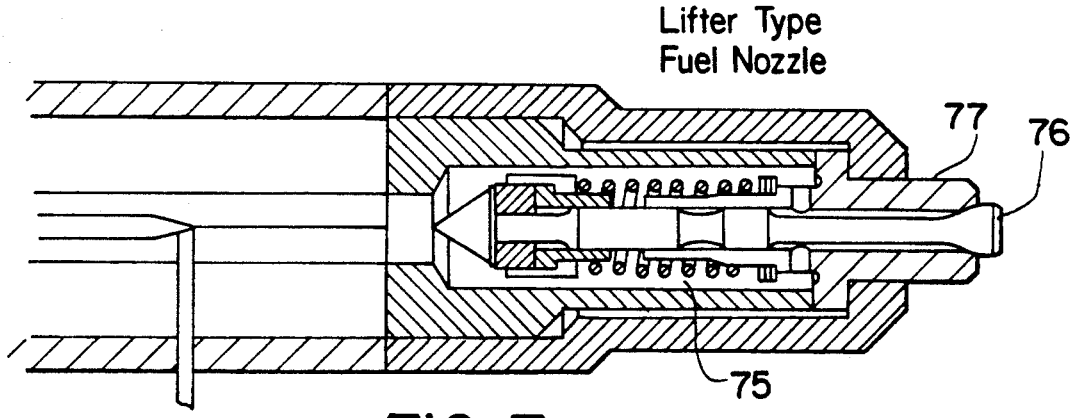
FIG. 7 illustrates the check valve at an injector.

In FIG. 7, the pressure pulse is passing through a typical fuel injector such that when the high pressure is delivered to the injector, it pushes the check valve 76 open against a spring 75 to go through a typical spray nozzle 77. However, in FIG. 8, when the energy is removed, collapsing of the bubble provides a suction mechanism to rapidly remove the pressure, which is very desirable for the fuel flow system, causing a sharp cut-off such that the droplet size of the fuel does not linger and generate smoke.

Figure 9:
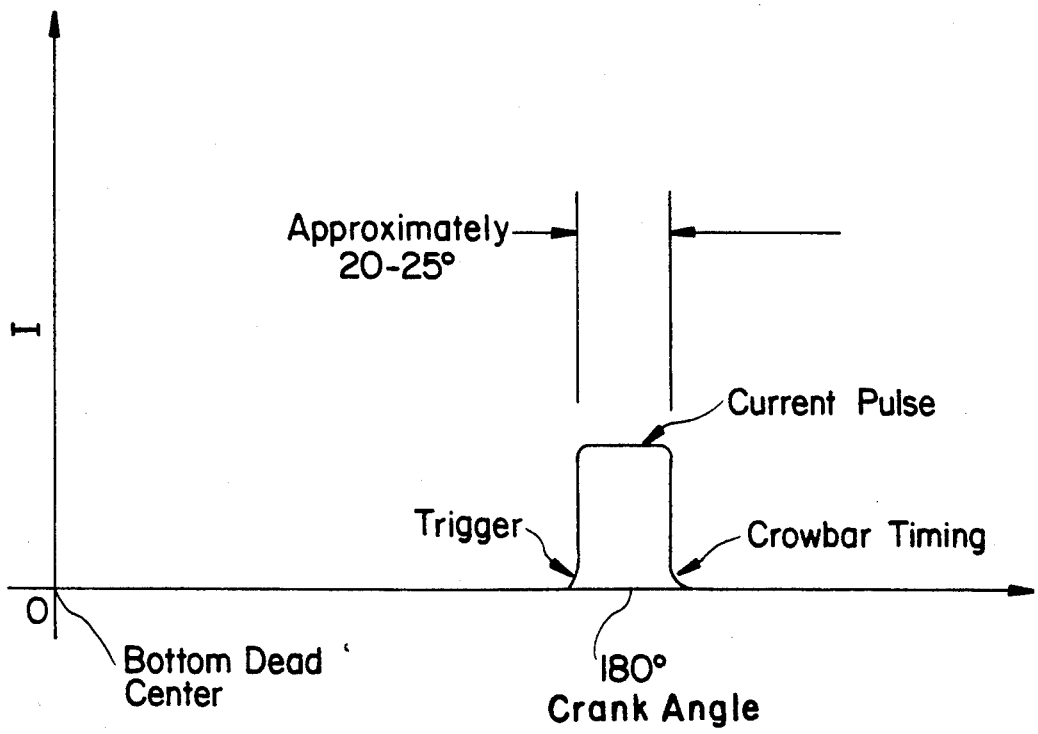
FIG. 9 depicts a single pulse time diagram.
Figure 10:
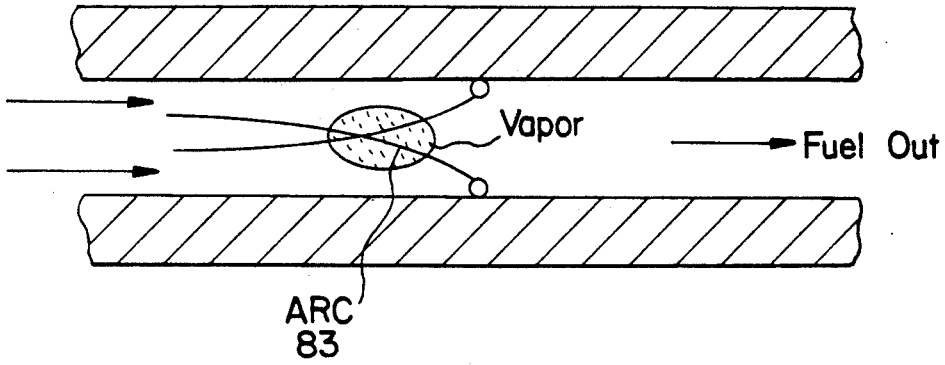
FIG. 10 illustrates that the heating element can be a spark.

FIG. 9 depicts a typical timing diagram assuming a single pulse where the energy is delivered between 20 to 25 degree crank angles. In FIG. 10, a high voltage spark 83 can be provided inside the liquid to produce a sudden input of energy. The advantage of the arcing device is that it can be produced as an extremely short pulse.

Figure 11:
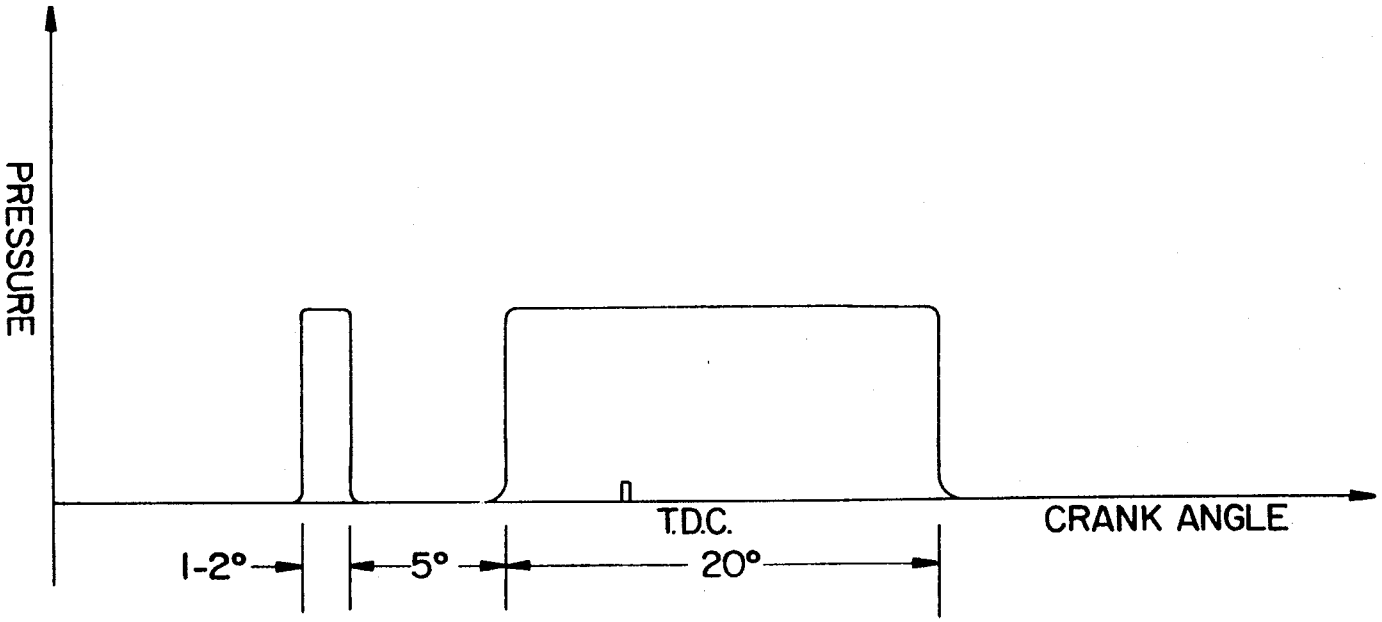
FIG. 11 illustrates a typical desired fuel pulse and crank angle for a high speed engine.

FIG. 11 is a typical example of a controlled pulse. A one to two degree crank angle is first used to inject a small amount of fuel to start a flame, with a time delay of about five degrees before the major fuel will be injected to produce a better combustion process. This process is due to a very small amount of fuel pilot in the front, essentially eliminating the knocking sound in the diesel engine device.

Figure 12:
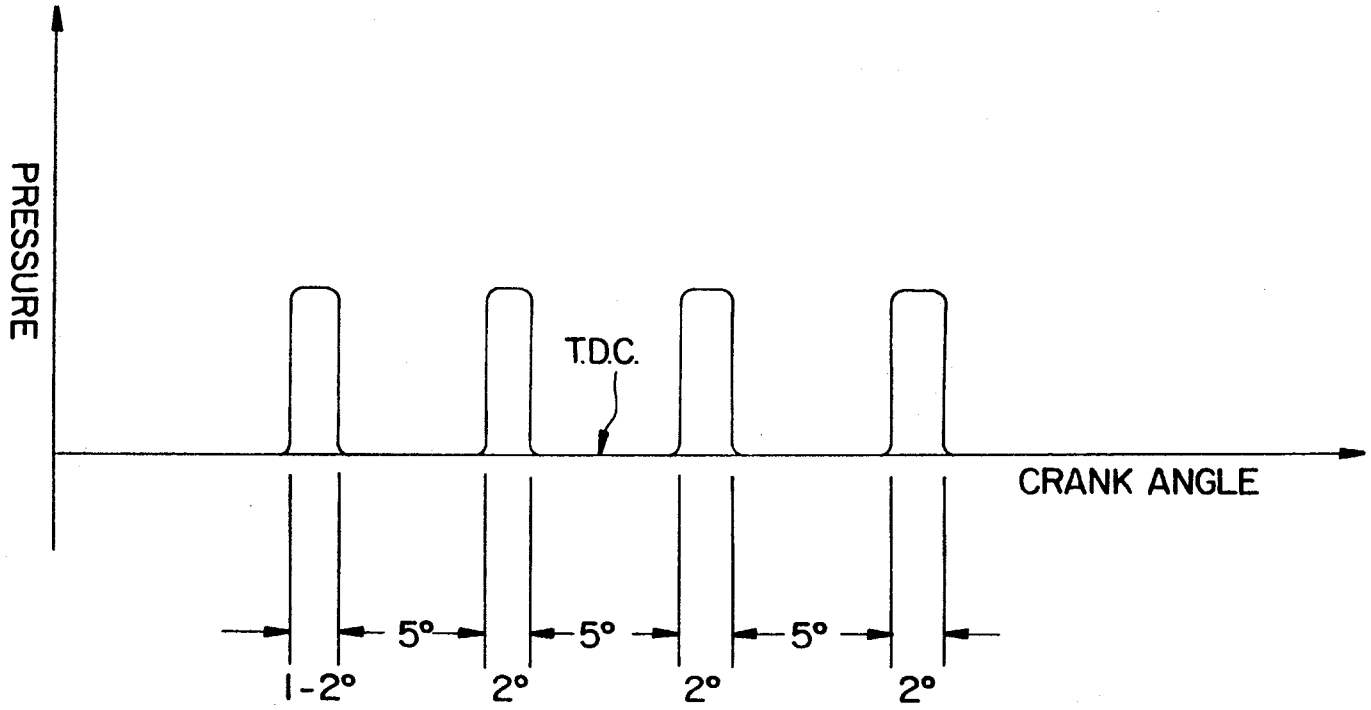
FIG. 12 illustrates a typical multiple pulse fuel control system to provide constant pressure combustion control.

FIG. 12 is a typical multiple pulse control system such that instead of just a pilot fuel, multiple pulses are illustrated here as an example to provide constant pressure combustion, which also suits well with the computer control mechanism for pulse energy controls.

Operation-FIGS. 1-9

It is obvious from the Applicant's invention that:

a) a controlled pressure pulse can be achieved with extremely short time;

b) the system can be located very close to the nozzle without a long fuel line to cause elastic waves;

c) a computer system can be fully utilized to control the system;

d) multiple fuel injection pulses can be achieved; and e) it is potentially simple and inexpensive to produce.

A new concept to overcome the difficulties of using a mechanical pump is being proposed here, which is an electrically heated pulse energy to a small diameter platinum or high temperature wire inside the fuel line of a diesel engine (FIG. 1). The way it works is that a highly tuned, high current electrical pulse is used to heat the resistive wire such that a film of fuel will be turned into a fuel vapor quickly when the heat input rate is much faster than the heat dispersion rate, in this case due to the fact that the thermal conductivity of diesel fuel is poor. When the vapor bubble is formed around the resistive wire, the thermal conductivity around the heated wire drops again by orders of magnitude and therefore allows the wire to heat the vapor to a high temperature and high pressure such that the vapor will expand into a larger volume. This sudden increase of volume is equivalent to the plunger of a mechanical piston pushed on a fuel. In order to build up the pressure, a check valve is used in the fuel line such that the sudden increase in pressure will not return the fuel back to its feed pump. A feed pump will supply the fuel to a pressure which allows the diesel fuel to be continuously fed through the injecting lines.

The diesel injector itself can be a traditional diesel injector. It consists of a check valve such that until the pressure of the diesel fuel reaches a certain level to lift the check valve, the diesel injector will be closed so that when the fuel is ready to be injected in the cylinder, the fuel will have a high enough pressure to be atomized. This also serves the purpose of shutting off the fuel injection quickly when the pressure in the fuel injection line is released. The vapor is formed because of a change in heat transfer from the small diameter wire to the fuel. On the other hand, when the input energy is removed, it can condense back to liquid under high pressure or convert vapor back into liquid fuel in a very short time. The convective motion of the liquid fuel will remove the vapor bubble from the surface of the wire, cooling off this vapor better by the surrounding liquid fuel. The fuel line will absolve the bubble rapidly and return it to a normal liquid state ready for the next pulse. This removes the long pressure profile tail which is needed to remove smoke.

The amount of energy required for diesel engine application is on the order of less than 10 joules. Such a small quantity of energy is similar to the energy used in a photo flash lamp, which requires anywhere between 5 and 100 joules. Therefore, the discharge circuit on the order of a sub-millisecond high current pulse is readily available from the discharge of xenon lamps and crowbar systems, etc. The solid state switching is then controllable by computer, which provides the sensing elements to sense the crank angle of the diesel engine, the RPM the diesel engine receives, input from the power setting required, and in the future could also sense the emission levels of diesel engine exhaust to set a time delay or advance for fuel injections and pulse durations. The circuit of such an element can be highly tuned in a way that the fuel pulse does not need to be following a mechanical type of pressure pulse, but can be tailored into a flatter type of pulse, which would also improve the diesel engine operations. A small control board of this type can be packaged in the size of a programmable chip (PAL). The circuit board will be on the order of 1 ½ inches by 3 inches per cylinder; therefore, the device can be extremely small, and all the computer chips can operate at extreme temperatures according to mil specs. Since the heating of the diesel fuel will lower the surface tension of the fuel, it will have the additional advantage of atomizing the fuel to finer droplets, which will promote combustion and reduce the soot formation in combustion chambers.

An illustration of the system working principle can be seen in FIG. 2. The fuel line 32 receives its fuel from the fuel feed pump 34, which only requires the pump to maintain a pressure of 100 psi or less. The fuel is pumped through the check valve 36 very close to the fuel injector 30, and the check valve is used to prevent the high pressure fuel from going back to the fuel pump. A tungsten, platinum or high temperature alloy wire 37 is situated approximately in the middle of the section of the fuel line such that electrical pulses can be fed through ceramic feed-throughs to heat the wire rapidly.

As illustrated in FIG. 1, when the wire is heated by electrical pulses, the wire will evaporate a small film of bubbles. In FIGS. 5 and 6, one can see that the bubble will serve as the piston to push onto the rest of the fuel contained in the fuel lines. Therefore, the bubble itself will be relatively small because it will reach rapidly to a very high pressure condition. FIG. 7 illustrates that the fuel is then pushed through conventional diesel nozzles.

Figure 8:
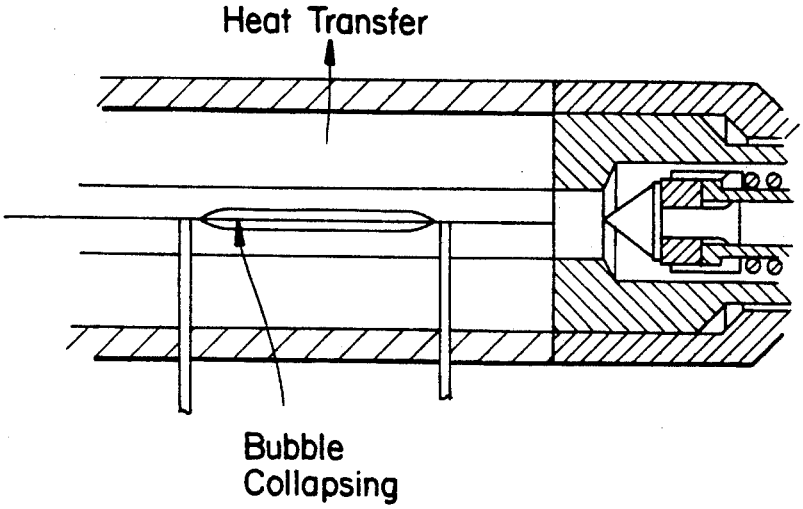
FIG. 8 illustrates the quick cut-off of the fuel when the bubble is collapsing.

FIG. 8 illustrates that the removal of electrical heating energy will immediately remove the vapor bubble formation and carry it out by heat conduction to the remaining fluid and by the additional fuel from the feed pumps. FIGS. 3 and 4 shows a typical timing circuit for discharge into such a system, which consists of silicon controlled rectifiers and a crowbar system, which will allow a capacitor to discharge its current at a very high level through the resistive wire of a small diameter. Such circuit has been used routinely in plasma research work.

FIG. 3 illustrates that a programmable computer chip 40 (PAL) can be used to detect the crank angles, the RPM and desired power output of the engine, then put out a trigger timing pulse to start the discharge of the capacitor in a crowbar system to stop the current from heating the wires. This kind of a control system can be used to replace the mechanical fuel injector systems in use today.

The advantages of the Applicant's invented system are obvious, such that the fuel injection system can still provide high injecting pressure at a small duration for fuel injection operations. In a diesel, now the advance of injection angle to compensate the combustion delay can be tuned just like gasoline spark advanced mechanisms, and the fuel duration, as well as the pressure, can be controlled. The system can be packaged into a much smaller, lighterweight system than mechanical diesel fuel injection systems or piezoelectric fuel injection systems. It is obvious that the system is not limited to diesel engine operation only.

SUMMARY, RAMIFICATIONS AND SCOPE

The electro-thermal fuel injection system as disclosed is extremely simple, lightweight and unique. It overcomes the traditional mechanical fuel injector system such that the pressure pulses are controlled electrically and the pressure does not go through very high pressure peaks. The rapid collapsing of the vapor bubble serves the purpose of a relief valve which quickly drops the pressure off to cut off the fuel without relief valve mechanism. This invention has the ramification of revolutionizing diesel engine operation such that the high efficiency diesel can have higher efficiency and the higher RPM capability will increase the horsepower-to-weight ratio to the gasoline engine with twice the fuel efficiency.

I claim:

1. A fuel injection system for delivering fuel to an internal combustion engine at a rate matching engine needs for substantially constant pressure combustion, said engine having a rotary crank and engine sensors, and said fuel injection system comprising:

a supply of liquid fuel;

a source of electrical pulses having selected shapes and occurring at a selected timing;

heating means coupled to receive said pulses and responsive to each received pulse to electrically heat said liquid fuel rapidly to thereby temporarily and locally change the liquid fuel to vapor and cause a corresponding temporary pressure rise;

means utilizing at least in part pressure rise for delivering fuel under pressure to said internal combustion engine.

means for controlling said source of electrical pulses to cause the delivery of a plurality of said electrical pulses to the heating means per combustion cycle of said engine, at a timing matching fuel flow needs for constant pressure combustion; and engine sensors and means coupled to said controlling means and to said sensors and said rotary crank to detect crank angle position and supply information respecting said sensors and said crank position to the controlling means to help time said train of pulses relative to combustion cycles.

2. A fuel injection system as in claim 1, wherein the heating means comprises a heating element in the form of a thin platinum wire.

3. A fuel injection system as in claim 1, wherein the heating means comprises a heating element made of a high temperature metal or its alloy.

4. A fuel injection system as in claim 1, wherein the controlling means comprises a programmed computer and means to monitor said sensors and thereby the condition of the engine and feed information thereon back to said computer.

5. A method of delivering fuel to an internal combustion engine by fuel injection at a rate matching fuel needs of the engine for substantially constant pressure combustion, comprising:

generating a succession of a short duration pressure pulses in a liquid fuel line for each combustion cycle of the engine by alternate rapid heating a small portion of the fuel to vapor and allowing the vapor to at least partially collapse in response to each of said pulses; and controlling said short duration pressure pulses relative to the TDC of combustion chambers of said engine for each combustion cycle to match fuel needs of the engine for substantially constant pressure combustion.

6. A method as in claim 5, including using check valves to help control the pressure pulse shape of said pressure pulses and utilizing the vapor collapse in the fuel line between said pressure pulses for quickly cutting off fuel flow to the engine.

7. A fuel injection system for supplying fuel for substantially constant pressure combustion in an internal combustion engine having at least one combustion chamber, comprising:

a fuel tank for liquid fuel, a fuel intake line supplied with liquid fuel from the fuel tank, a pump receiving fuel from the fuel intake line and delivering the received fuel to an outlet line at a raised pressure, pressure regulator means coupled to said outlet line to regulate the fuel pressure therein, a check valve, a high pressure fuel line coupled to the outlet line through said check valve to receive fuel therefrom, said check valve providing for one way flow only of fuel from the outlet line to the high pressure line;

an electro-thermal unit in said pressure line, a fuel nozzle coupled with the pressure line downstream from the electro-thermal unit, and another check valve which is between the electro-thermal unit and the fuel nozzle to provide one way flow into the fuel nozzle;

an energy network coupled with the electro-thermal unit to deliver energy pulses thereto, said electro-thermal unit responding to each energy pulse to rapidly heat and locally and temporarily vaporize fuel and thereby cause a fuel pulse to be delivered through said another check valve to said nozzle;

a programmed computer coupled to the energy delivery network to control the delivery of energy pulses to the electro-thermal unit to cause the electro-thermal unit to deliver a number of fuel pulses to each combustion chamber of the engine for each combustion cycle;

a crank position sensor, an RPM detector and at least one other sensor coupled to the computer and to the engine to derive information regarding engine requirements and supply said information to the computer for use in controlling the delivery of energy pulses to the electro-thermal unit; and said computer controlling the delivery of said energy pulses to the electro-thermal unit to cause the delivery of fuel pulses matching engine needs for substantially constant pressure combustion.

8. A method of using an electro-thermal fuel injection system comprising operating the fuel injection system for each combustion cycle and each combustion chamber to:

first inject into the combustion chamber a relatively minor amount of fuel to establish a pilot flame; and thereafter inject into the combustion chamber a relatively major amount of fuel as a sequence of fuel pulses arranged to match fuel needs for substantially constant pressure combustion.

9. A method of using an electro-thermal fuel injection system as in claim 8, including energizing said system with a sequence of electrical pulses causing the step of injecting a relatively major amount of fuel after the pilot flame to comprise the injection of discrete multiple fuel pulses for each combustion cycle, each fuel pulse corresponding to a respective one of said electrical pulses.

10. An electro-thermal pressure pulse generator for supplying a sequence of fuel pulses per combustion cycle for each combustion chamber of an internal combustion engine, comprising:

a high pressure fuel line supplying fuel to the engine:

a source of electrical energy pulses;

an electro-thermal fuel pulse generating device in line with said high pressure fuel line and responsive to each energy pulse to generate a respective fuel pulse for delivery to said engine;

a control coupled with the fuel pulse generating device to control the delivery of said energy pulses thereto and thereby the delivery of said fuel pulses to the engine to cause each combustion chamber in the engine to receive for each combustion cycle a plurality of fuel pulses delivering fuel at a rate matching fuel needs for substantially constant pressure combustion.

11. An electro-thermal pressure pulse generator as in claim 10, wherein the electro-thermal device comprises a material inserted in the fuel flow through said high pressure high and selected from the group consisting of: (i) an electrically conductive thin film attached to an electrically insulating material wall, (ii) a length of an electrically conductive thin wall conduit enclosed by said high pressure line and spaced therefrom by an electrically insulating material, and (iii) a length of an electrically conductive wire or strip.

* * * * *